US005498011A

United States Patent [19]

Kilada et al.

[11] Patent Number: 5,498,011

[45] Date of Patent: Mar. 12, 1996

[54] LIFELINE RETRIEVAL DEVICE

[75] Inventors: Ashraf N. Kilada, Malverne, N.Y.; Michael J. Burlingame, E. Liverpool; Steven D. Belaney, E. Palestine, both of Ohio

[73] Assignee: American Safety Products, Inc., Baldwin, N.Y.

[21] Appl. No.: 190,281

[22] Filed: Feb. 2, 1994

[51] Int. Cl.[6] ..... A62B 1/10; E04G 3/10

[52] U.S. Cl. ..... 280/47.34; 280/638; 182/142

[58] Field of Search ..... 280/47.34, 638, 280/35, 79.11; 180/7.5; 182/142, 150; 212/187

[56] References Cited

U.S. PATENT DOCUMENTS

| | | | |
|---|---|---|---|
| 3,159,110 | 12/1964 | Wylie | 182/142 |
| 4,004,778 | 1/1977 | Steinhagen | 182/142 |
| 4,130,179 | 12/1978 | Williams | 182/142 |
| 4,183,423 | 1/1980 | Lewis | 182/142 |
| 4,589,523 | 5/1986 | Olson et al. | 182/234 |
| 5,065,838 | 11/1991 | Finley | 182/142 |
| 5,135,078 | 8/1992 | Bell et al. | 182/142 |
| 5,294,136 | 3/1994 | Dick et al. | 180/7.5 |
| 5,341,898 | 8/1994 | Baziuk | 182/142 |

*Primary Examiner*—Margaret A. Focarino
*Assistant Examiner*—Carla Mattix
*Attorney, Agent, or Firm*—Sand & Sebolt

[57] ABSTRACT

A self contained portable device for use on the roof of a building for retrieving a lifeline from along the side of the building. A motor and drum drive assembly is mounted on a movable cart. An adjustable davit arm is pivotally mounted on the cart and is adapted to extend over the edge of the roof. The lifeline extends around a sheave mounted on the outer end of the davit arm and through a rope grab clamp and then about the take-up drum of the drive assembly. The davit arm is formed by telescopically joined tubular arm sections. The motor is controlled by a foot operated switch for rotating the drum to retrieve the lifeline. A safety line is adapted to secure the cart to rigid structure on the roof in addition to a wheel brake.

19 Claims, 5 Drawing Sheets

FIG-3
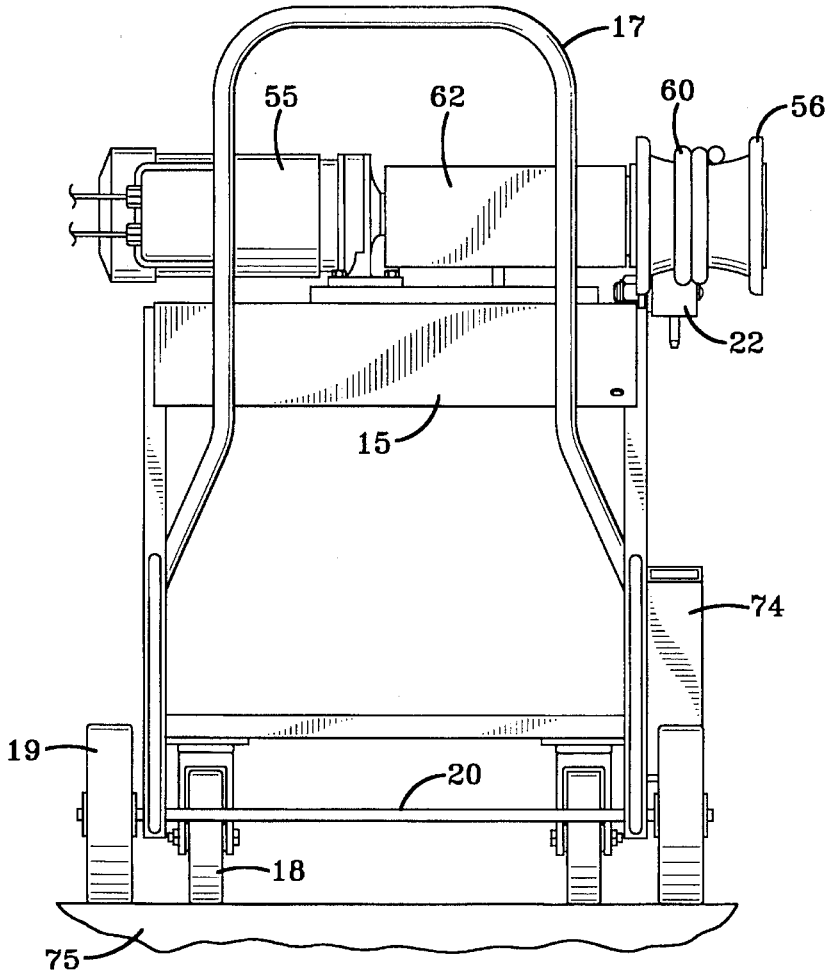
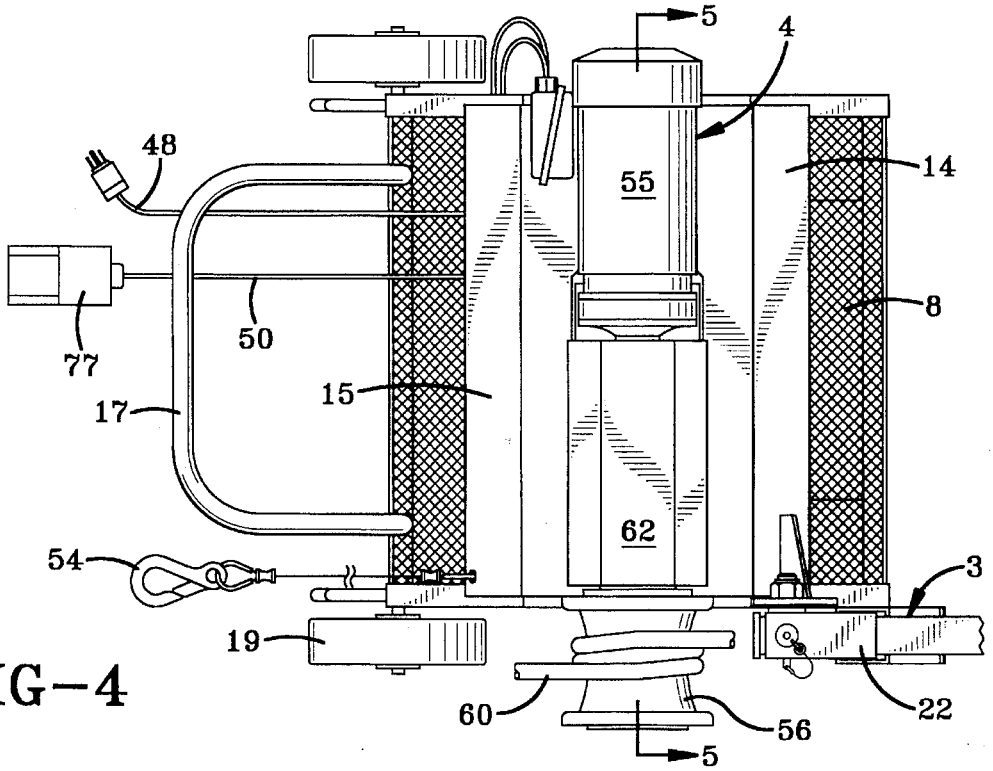
FIG-4

LIFELINE RETRIEVAL DEVICE

BACKGROUND OF THE INVENTION

1. Technical Field

The invention relates to a retrieval device and in particular to a device used on the roof of a building for retrieving a lifeline which extends along the side of a building. More particular, the invention relates to such a device which is self-contained and mobile for movement along a roof for retrieving the lifeline.

2. Background Information

Safety regulations require that a lifeline extend along the side of a building for connection to a rope clamp which is adapted to be connected to a worker while working on a scaffold which is suspended along the side of a building. Thus, in the event of a malfunction in the scaffolding or the worker losing his or her balance, the lifeline reduces the possibility of the worker being injured upon falling from the scaffold. However, when moving the scaffold laterally along the building to a new work position, it is necessary to retrieve the lifeline and then reinstall it over the side of the building at the next position of the scaffold. Typically, these lifelines are in 500 foot lengths weighing approximately sixty pounds. Therefore, it is relatively difficult and time consuming for a workman to repeatedly handle and manually pull up the rope each time the scaffold is moved, and then release the rope again over the side of the building and along the side of the scaffolding.

There is no known device of which we are aware which permits this lifeline to be retrieved easily and conveniently by a portable device located on the roof of the building before movement of a scaffold to a different position on the building.

SUMMARY OF THE INVENTION

Objectives of the invention include providing a retrieval device which is easily moved manually along the roof of a building for retrieving a lifeline from along the side of the building, each time a scaffold is moved to a different position on the side of the building.

A still further objective of the invention is to provide such a device which is relatively lightweight and rugged, yet which provides for the rapid retrieval of the lifeline each time the scaffold is relocated along the side of a building in an extremely safe and convenient manner.

Still another objective of the invention is to provide such a device which uses a take-up drum that is operated by an electrical motor controlled by a foot-operated switch, thereby leaving a worker's hands free for use in controlling the lifeline as it is being retrieved.

Another objective of the invention is to provide such a device which is provided with a safety brake for locking the wheels of the mobile cart in a locked position, and which has an additional safety line which extends between the mobile cart and a rigid structure on the roof to further prevent movement of the cart once it is placed in position adjacent the edge of the roof.

A further objective of the invention is to provide such a device which utilizes a pivotally mounted davit arm for extending the lifeline over the edge of the roof and beyond any parapet or similar edge structures, preventing contact of the lifeline with the building, and which provides free movement of the lifeline over a winch mounted on the end of the davit arm; and in which the davit arm is placed in a raised, stored position when being moved between job sites.

A still further objective of the invention is to provide such a device having a power-driven wind-up drum which is provided with a load limiting mechanism to prevent excess pull-up force from being applied to the lifeline during retrieval.

Another objective is to provide such a device which has safety catches to prevent excessive pull-out of the davit arm sections during adjustment by a worker.

These objectives and advantages of the invention are achieved by the improved lifeline retrieval device of the invention, the general nature of which may be stated as including a mobile cart adapted for movement along the roof of a building; a davit arm pivotally mounted on the cart; take-up drum means mounted on the cart for retrieving a length of lifeline extending from the drum means and along the davit arm and along the side of the building; and motor means for rotating the drum means to retrieve the lifeline from the side of the building.

BRIEF DESCRIPTION OF THE DRAWINGS

The preferred embodiment of the invention, illustrative of the best mode in which applicants have contemplated applying the principles, is set forth in the following description and is shown in the drawings and is particularly and distinctly pointed out and set forth in the appended claims.

FIG. 3 is a rear elevational view of the device;

FIG. 4 is a top plan view of the device;

Similar numerals refer to similar parts throughout the drawings.

DESCRIPTION OF THE PREFERRED EMBODIMENT

Figure 1:
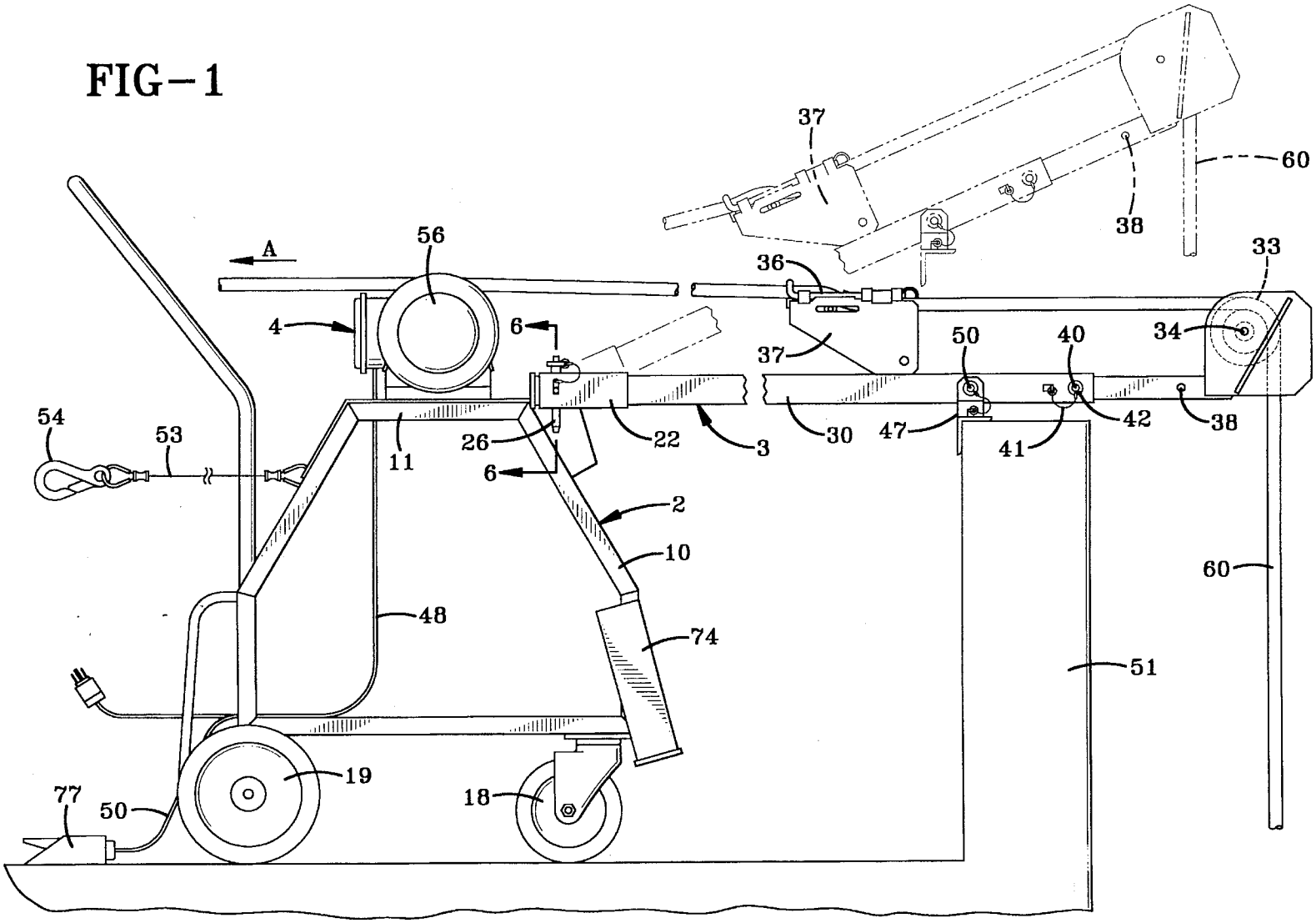
FIG. 1 is a side elevational view of the improved lifeline retrieval device mounted on a roof with the davit arm being shown in full lines in operative position.

The improved lifeline retrieval device of the invention is indicated generally at 1, and is shown particularly in FIGS. 1—4. Device 1 includes as its main components a movable cart 2, a davit arm 3 and a winch-drum assembly 4.

Cart 2 has a rectangular base 6 formed by a metal frame 7 and a mesh screen 8. Four angled frame members 10 formed of steel channels are secured, preferably by welding, to the corners of base 6 and extend upwardly therefrom and are joined by top horizontal cross members 11, on which is mounted a top support platform 12. A pair of reinforcing plates 14 and 15 extend downwardly from the front and rear of top platform 12 and are connected to end members 10. An upwardly rearwardly extending handle 17 is attached to the two rear end members 10 for pushing or pulling the cart along a roof.

Cart 2 is movably supported by two pairs of wheels 18 and 19, each pair being supported on an axle 20. A usual manually operated brake (not shown) is mounted on each of the pivotally mounted front pair of wheels 18, which when actuated prevents rotation of the wheels and therefore prevents rolling movement of the cart.

The particular construction of cart 2 shown in the drawings and described above, in which it is formed of angled channels, can be modified without affecting the concept of the invention. However, the construction shown provides for a relatively lightweight, yet sturdy and durable cart for achieving its intended function as described more fully below.

Figure 2:
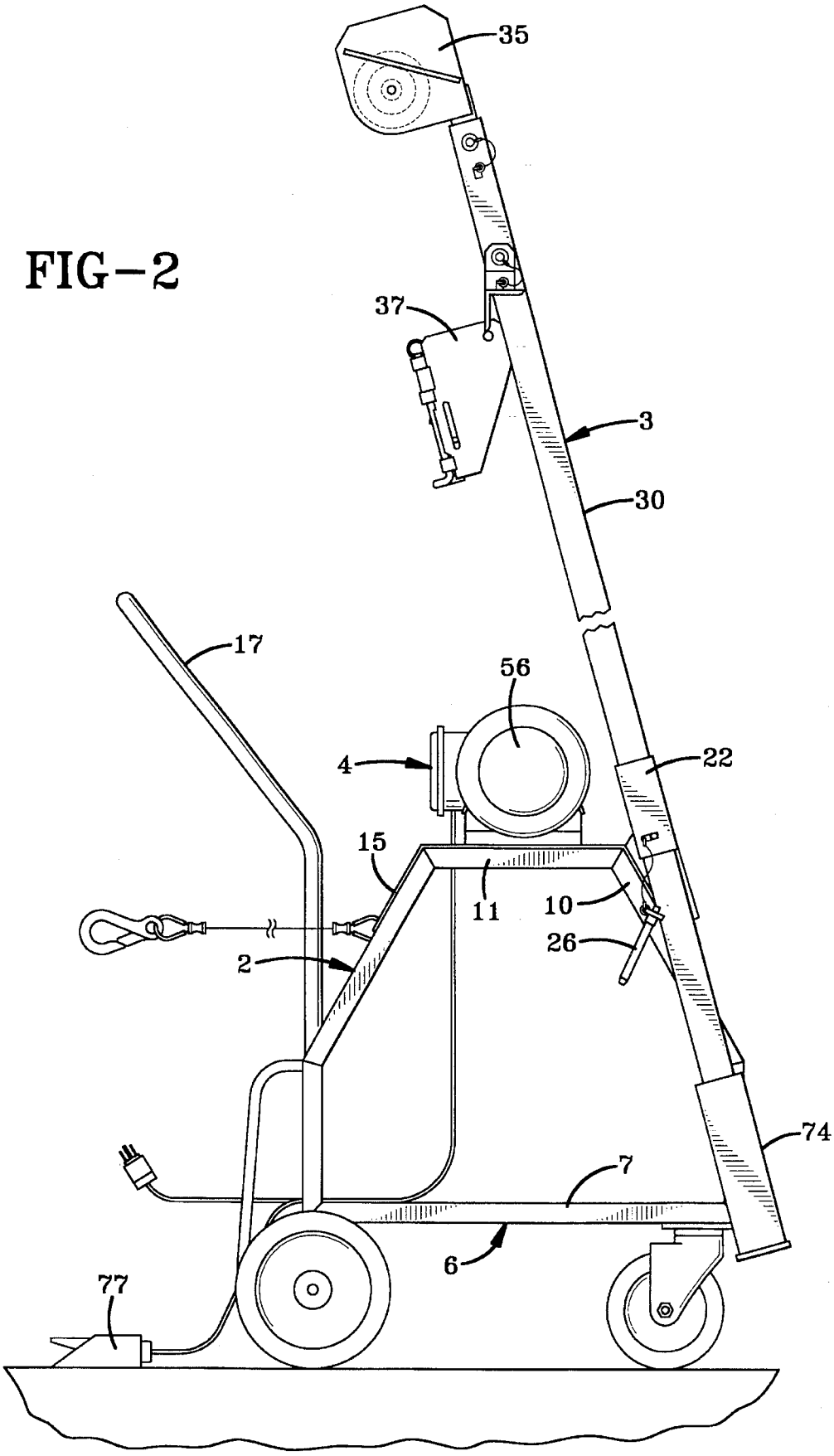
FIG. 2 is a side elevational view of the device of FIG. 1 with the davit arm in a stored position.
Figure 6:
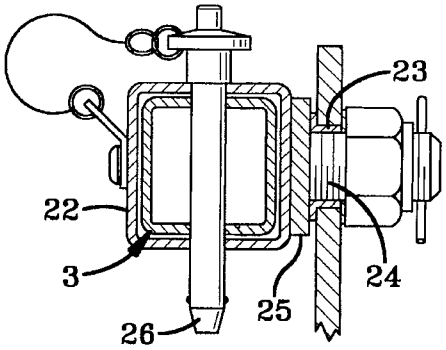
FIG. 6 is an enlarged fragmentary sectional view taken on line 6—6, FIG. 1.
Figure 7:
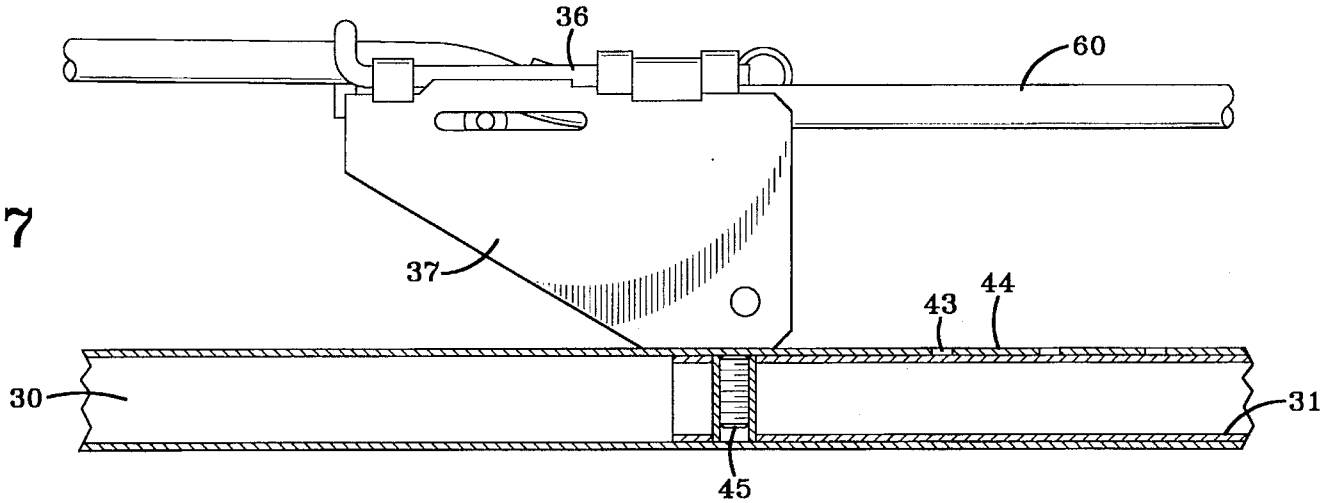
FIGS. 7 and 7A are enlarged fragmentary sectional views of the davit arm.

Davit arm 3 is pivotally mounted on cart 2 as shown in FIGS. 1, 2 and 6. Davit arm 3 is slidably mounted within a complementary-shaped tubular sleeve 22 and is selectively secured therein by a pin 26. Sleeve 22 is secured to the head 25 of a bolt 24 (FIG. 6) which extends through and is pivotally mounted within a flange bearing 23. Davit arm 3 includes at least two telescopically engaged hollow rectangular shaped tubular sections 30 and 31 (FIG. 7). A sheave 33 is rotatably mounted on the extended end of outer arm section 31 by a axle 34 which extends between a pair of spaced mounting plates 35 (FIG. 1). A rope grab clamp 37 is mounted on the outer end of inner tubular arm section 30. Clamp 37 may be of the type manufactured and distributed by D.B. Industries, Inc. of Red Wing, Minn. under its Model No. LS-34. Grab clamp 37 is mounted on arm section 30 preferably by welding.

Figure 7A:
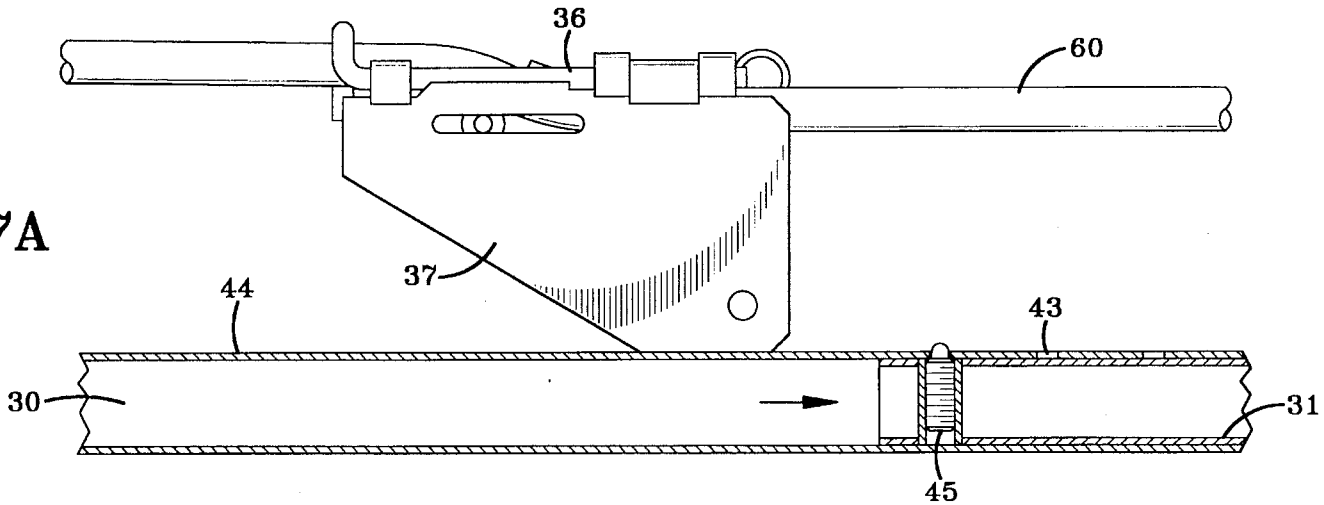

As shown in FIGS. 1 and 2, the spaced parallel side walls of outer arm section 31 are formed with a plurality of horizontally extending aligned holes 38, which when in alignment with a corresponding pair of holes 42 formed in the outer end of tubular section 30, receives a release pin 40 therethrough to secure the arm sections in an adjusted extended position. Pin 40 preferably is connected by a short section of cable 41 to the end of inner arm section 30 to prevent its accidental loss. A plurality of holes 43 (FIGS. 7 and 7A) are formed in top wall 44 of inner arm section 30 adjacent its outer end for engagement with a spring actuated plunger 45. Plunger 45 is mounted within the inner end of outer arm section 31 for automatic projection through one of the holes 43 for releasably retaining arm sections 30 and 31 in an outermost extended position. This mechanism provides a signal to the worker that arm section 31 has reached its outermost position. Plunger 45 also prevents arm section 31 from accidentally being pulled completely out of the open end of inner arm section 30 and dropped over the edge of a roof.

A davit support 47 which is formed by a right angle plate, is pivotally mounted by a pin 50 adjacent the extended end of arm section 30 to support davit arm 3 in an adjusted generally horizontal position as shown in FIG. 1, on a roof parapet 51.

A safety line 53 is secured at one end to cart 2 with its opposite end being provided with a tie-off clamp 54 adapted to be connected to a rigid support on the roof after the cart has reached its operating position to further secure the cart on the roof and to prevent it from accidentally being pulled over the edge of the roof.

Figure 5:
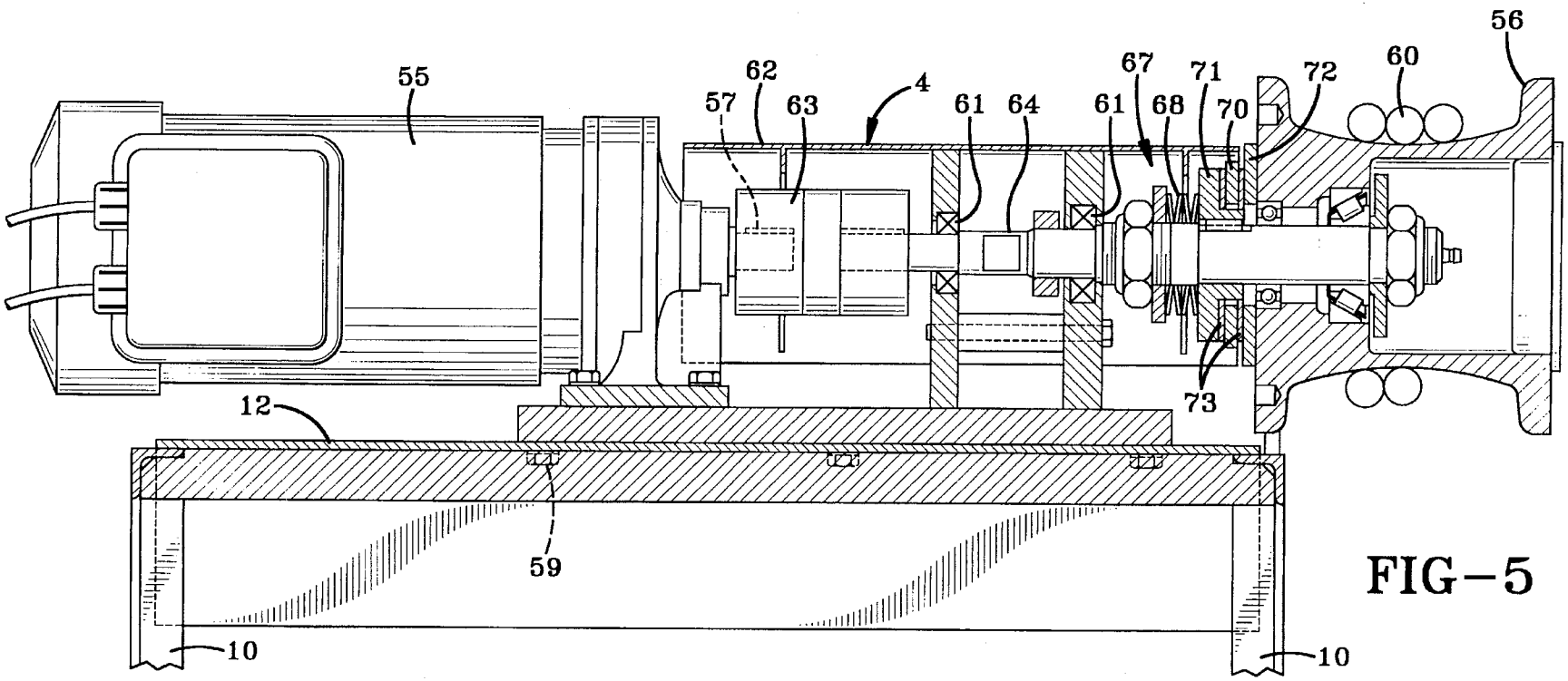
FIG. 5 is an enlarged fragmentary sectional view of the winch-drum assembly taken on line 5—5, FIG. 4.

Referring to FIGS. 4 and 5, winch-drum assembly 4 includes an electric motor 55, which in the preferred embodiment is a 120/240 v single phase, one-half HP. Motor 55 is connected to a source of electric power by a power cord 48 (FIG. 1). The motor output shaft 57 is connected by a coupling 63 to one end of a drive shaft 64. The other end of the drive shaft rotatably supports a take-up drum 56 by spaced bearings 52 and by a drum retainer 65 and locking nut 66. Drive shaft 64 also is rotatably supported in a pair of spaced bearings 61. In accordance with one of the features of the invention, a load limiting clutch 67 provides the driving connection between drive shaft 64 and drum 56. A plurality of Bellville springs 68 and friction discs 69 are located between an overload brake hub 71 and a traction plate 72 which is rigidly connected by bolts (not shown) to drum 56. A brake spacer 70 is located between a pair of friction discs 73.

The winch-drum assembly is mounted on top platform 12 of cart 2 by a plurality of mounting bolts 59. Take-up drum 56 has a smooth concave configuration adapted to receive several wraps of a lifeline 60 when operated in the manner described below. A sheet metal safety cover 62 forms a housing for the drive winch mechanism, load limiting mechanism and associated support bearings and shafts which drivingly connect motor 55 to drum 56.

The operation of the improved lifeline retrieval device is best illustrated in FIGS. 1 and 2. Cart 2 is rolled along a roof 75 by a worker pushing or pulling on handle 17 to a position closely adjacent the edge of the roof or parapet 51. Initially, davit arm 3 is in a raised stored position as shown in FIG. 2. The davit arm is lifted from a storage socket 74 by the sliding engagement of arm 3 through tubular sleeve 22, after which arm 3 is secured to sleeve 22 by pin 26. Arm 3 then is pivoted to a generally horizontal position on pivot bolt 24 where it will extend over parapet 51, in which position support 47 will automatically pivot downwardly and rest upon the top of the parapet. Prior to this engagement, the davit arm is adjusted to its desired length by initially removing release pin 40, which is then reinserted through aligned holes 38 after the davit arm has been adjusted to its desired length.

Rope grab clamp 37 is then opened by pulling pin 36 therefrom. Lifeline 60 then is inserted in clamp 37 after which the clamp is closed and pin 36 reinserted. Lifeline 60 is then inserted into and over sheave 33 by one worker as another worker pushes the extended davit arm over the parapet wall so that the lifeline clears the building, approximately four inches maximum. Next, the front wheel brakes are set on the cart and the lifeline is then wrapped twice about take-up drum 56 in a counter-clockwise direction. Prior to wrapping line 60 about the drum, safety line 53 is attached to a rigid supporting structure on the roof.

To retrieve lifeline 60 from its position along the side of a building, a foot-actuated switch 77 which is connected to motor 55 by an electric cord 50 is then depressed and the worker applies a pulling pressure on the lifeline, as shown by arrow A in FIG. 1, as it is being pulled up by the rotation of drum 56. Only a slight amount of force is required to be applied to the lifeline by the workman in order to maintain tension on the rope to prevent its slipping as the drum rotates. This enables the worker to coil the pulled-up rope after it passes around and beyond the drum, until the entire rope is retrieved from along side of the building.

After the lifeline has been retrieved, the safety line is disconnected and the foot brake is released and the cart is moved manually to the next location where the lifeline is then dropped along the side of the building to adjacent the repositioned scaffold. The lifeline is then reconnected to device 1, as discussed above.

Rope grab clamp 37 provides a safety mechanism so that in the event the lifeline experiences a downward force thereon, such as a worker losing his or her balance, the clamp will automatically grab the rope and prevent it from moving further downwardly, preventing injury and possibly death to the worker. Safety line 53 which connects cart 2 to a supporting structure, in combination with lifeline 60, will retain the lifeline in a secure condition.

Thus, retrieval device 1 provides for a relatively lightweight yet sturdy construction, which is formed of rigid metal channels, which can be moved easily on its supporting wheels to any desired location on a roof for use with a scaffold or other application where a safety line is used. The pivotally mounted davit arm can be telescopically retracted and pivoted to a stored position for movement between job sites and upon reaching a desired location on a roof can be removed from its storage socket and then extended to a desired extension length sufficient to clear, and preferably rest upon, a roof parapet, to provide sufficient clearance for the lifeline with respect to the side of the building.

Another advantage is that after actuation of the motor by foot operated switch 77, a worker only needs to maintain a slight pressure on the lifeline as it extends from the take-up drum, permitting the worker to retrieve and coil the rope into a safe condition adjacent cart 2 as it is being retrieved from along the side of the building. In the preferred embodiment, device 1 retrieves the lifeline at a rate of 120 feet per minute, and the davit arm has a maximum extension of 106 inches, adjustable in six-inch increments. Likewise, safety line 53 is formed of a 5/32 inch diameter stainless steel aircraft cable, approximately eight feet in length, with double locking snap hook 54 being provided on one end thereof, for securing it to a rigid structure.

Accordingly, the lifeline retrieval device of the invention is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved lifeline retrieval device is constructed and used, the characteristics of the construction, and the advantageous, new and useful results obtained; the new and useful structures, devices, elements, arrangements, parts and combinations, are set forth in the appended claims.

We claim:

1. A device for retrieving a lifeline from the side of a building including:

a mobile cart adapted for movement on a roof of a building;

a davit arm pivotally mounted on said cart, said davit arm including a sheave mounted on an extended end of the arm;

take-up drum means mounted on the cart for retrieving a length of lifeline extending from said drum means and along the davit arm and along the side of the building;

a line grab clamp mounted on the davit arm inboard of the shears; and motor means for rotating the drum means to retrieve the lifeline from along the side of the building.

2. The device defined in claim 1 including brake means mounted on the cart for stopping the cart in a selected position.

3. The device defined in claim 1 which the cart includes spaced top and bottom platforms; and in which the drum means and motor means are mounted on said top platform.

4. The device defined in claim 1 which the cart includes handle means for manually moving the cart along a roof.

5. The device defined in claim 4 in which the cart includes a frame; and in which the handle means is mounted on an end of the cart for pulling or pushing said cart along a roof.

6. The device defined in claim 1 in which the davit arm includes pivot means pivotally mounting said arm on the cart; and in which said arm includes at least a pair of telescopically joined arm sections.

7. The device defined in claim 1 in which a support bracket is mounted on the davit arm inboard of the sheave for supporting the extended end of said arm on a roof parapet.

8. The device defined in claim 7 in which the support bracket includes a right angle bracket pivotally mounted on the davit arm.

9. The device defined in claim 6 in which a plurality of holes are formed in the pair of arm sections; and in which quick release pin means selectively extend through aligned pairs of said holes for securing said arm sections in an extended position.

10. The device defined in claim 6 in which a plurality of holes are formed in one of the pairs of arm sections; and in which spring-biased plunger pins is mounted in another of said arm sections for selective engagement in at least one of said holes for retaining said arm sections in an adjusted position.

11. The device defined in claim 1 in which the davit arm is slidably mounted in a complementary-shaped sleeve; and in which pivot means pivotally mount said sleeve on the cart.

12. The device defined in claim 11 in which a davit arm storage socket is mounted on the cart for receiving an inner end of said davit arm therein when said davit arm is in a stored position.

13. The device defined in claim 6 in which the davit arm sections are hollow rectangular tubular members.

14. The device defined in claim 1 in which the sheave is rotatably mounted on a shaft which extends between a pair of spaced support plates secured to the extended end of the davit arm.

15. The device defined in claim 1 including foot-operated switch means for controlling the motor means for rotating the drum means.

16. The device defined in claim 1 including safety line means connected to the cart for attachment to a rigid structure on the roof.

17. The device defined in claim 1 in which load limiting means drivingly connect the motor means to the drum means.

18. In combination, a lifeline and a device for retrieving said lifeline from the side of a building including:

a mobile cart adapted for movement on a roof of a building;

a davit arm mounted on said cart;

a line grab clamp mounted on the device and operatively engageable with the lifeline;

a drum mounted on the cart for retrieving a length of lifeline extending from said drum and along the davit arm and along the side of the building, said drum having only several wraps of the lifeline extending thereabout and extending away from the drum in an opposite direction from the davit arm;

motor means for rotating the drum to retrieve the lifeline from along the side of the building; and a load-limiting clutch drivingly connecting the motor to the drum.

19. The combination defined in claim 18 in which the davit arm includes a sheave mounted on an extended end of said arm and in which the line grab clamp is mounted on said davit arm inboard of said sheave.

* * * * *